US007240866B2

(12) United States Patent
Packer et al.

(10) Patent No.: US 7,240,866 B2
(45) Date of Patent: Jul. 10, 2007

(54) SYSTEMS AND METHODS FOR RECYCLING ASPHALT

(76) Inventors: David A. Packer, 1255 N. Ivy Pl., Kaysville, UT (US) 84037; Todd Morgan, 1250 N. Ivy Pl., Kaysville, UT (US) 84037; Mark Bjarnson, 2148 W. 550 N., Kaysville, UT (US) 84037; Robert Van Arsdale, 869 N. 900 E., Bountiful, UT (US) 84010

( * ) Notice: Subject to any disclaimer, the term of this patent is extended or adjusted under 35 U.S.C. 154(b) by 0 days.

(21) Appl. No.: 11/609,456

(22) Filed: Dec. 12, 2006

(65) Prior Publication Data

US 2007/0080248 A1 Apr. 12, 2007

Related U.S. Application Data

(62) Division of application No. 10/614,464, filed on Jul. 7, 2003, now Pat. No. 7,150,420.

(51) Int. Cl.
*B02B 1/08* (2006.01)
*B02C 13/00* (2006.01)
*B02C 1/10* (2006.01)

(52) U.S. Cl. ..... 241/65; 241/78; 241/299

(58) Field of Classification Search ..... 241/65, 241/78, 299; 404/75, 77
See application file for complete search history.

(56) References Cited

U.S. PATENT DOCUMENTS 4,089,508 A 5/1978 Anderson
4,256,414 A 3/1981 Milligan
4,946,307 A 8/1990 Jakob
5,294,062 A 3/1994 Hendrickson et al.
5,335,989 A 8/1994 Tanaka
5,520,342 A 5/1996 Hendrickson et al.
5,613,902 A 3/1997 Didion et al.
5,624,077 A 4/1997 Branscome
5,743,471 A * 4/1998 Ivanov ..... 241/16
5,791,814 A 8/1998 Wiley
5,848,755 A 12/1998 Zickell et al.
5,938,130 A 8/1999 Zickell
6,290,152 B1 9/2001 Zickell
6,425,685 B1 7/2002 Chuan
7,150,420 B2 * 12/2006 Packer et al. ..... 241/23

* cited by examiner

*Primary Examiner*—Faye Francis
(74) *Attorney, Agent, or Firm*—Kirton & McConkie; Michael F. Krieger

(57) ABSTRACT

Systems and methods for receiving used asphalt materials, heating the materials, dynamically tumbling the materials into a recycled granulized form, and selectively providing the recycled asphalt for use. An asphalt recycling system is used that is configured to receive used asphalt materials, including RAP and asphalt chunks. Inside the system, the asphalt materials are heated in a heating chamber, such as by natural gas, propane, or another heat source. The heating chamber warms the metal in the chute, and material in the chute can be exposed to exhaust gas, which preheats the asphalt material. The material is then delivered through the chute and onto a conveyer belt, which drops down into a rotating drum. The drum includes a material classifier ring and a plurality of paddles that are used to tumble the heated asphalt material until it becomes generally granularized. The drum can be manipulated (e.g., tilted, etc.) so that the material can be maintained in the drum until the asphalt material is ready to be reused.

20 Claims, 7 Drawing Sheets

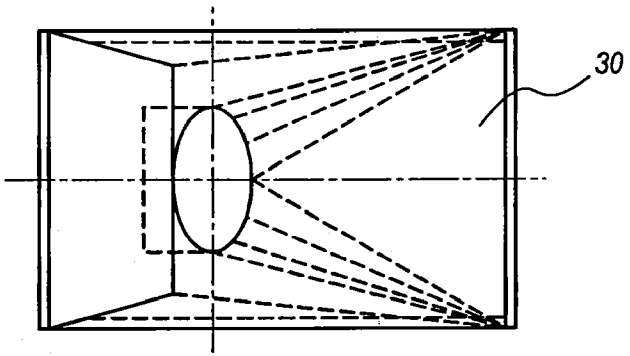
FIG. 3B
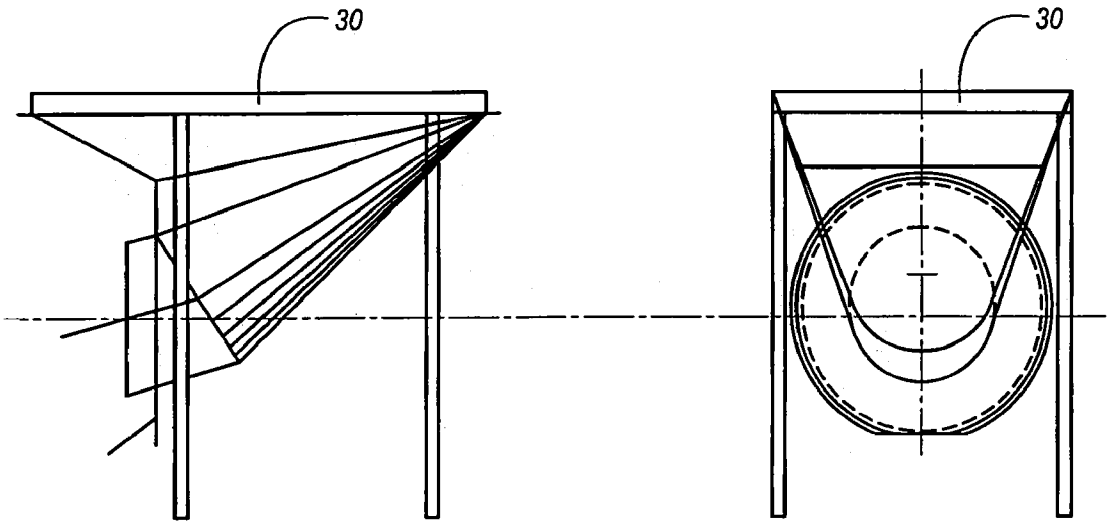
FIG. 3C
FIG. 3A

SYSTEMS AND METHODS FOR RECYCLING ASPHALT

This application is a divisional of U.S. patent application Ser. No. 10/614,464, filed Jul. 7, 2003 now U.S. Pat. No. 7,150,420, and entitled "Systems and Methods for Recycling Asphalt".

BACKGROUND OF THE INVENTION

1. Field of the Invention

The present invention relates to recycling asphalt. In particular, the present invention relates to systems and methods for receiving used asphalt materials, including recycled asphalt pavement ("RAP") and asphalt chunks, heating the materials, dynamically tumbling the materials into a recycled granulized form, and selectively providing the recycled asphalt for use.

2. Background and Related Art

Asphalt has proven to be a valuable material for use in a variety of applications. For example, one such application that utilizes asphalt is road construction. Once a road has been constructed, the natural climate and use of the roads requires ongoing maintenance. The road maintenance can be particularly difficult when it is being performed in remote locations, at odd hours and/or during cold weather.

Thus, while techniques currently exist that provide asphalt for use in a particular application, such as road construction, challenges still exist. Accordingly, it would be an improvement in the art to augment or even replace current techniques with other techniques.

SUMMARY OF THE INVENTION

The present invention relates to recycling asphalt. In particular, the present invention relates to systems and methods for receiving used asphalt materials, including RAP and asphalt chunks, heating the materials, dynamically tumbling the materials into a recycled granulized form, and selectively providing the recycled asphalt for use.

Implementation of the present invention takes place in association with an asphalt recycling system that is configured to receive used asphalt materials, including RAP and asphalt chunks. In one implementation, when asphalt is broken or torn up from a road, the asphalt recycling system is brought in and actuated.

The asphalt materials include RAP, which includes the small granular output of asphalt milling machines, and chunks, which are not granularized. An asphalt chunk can vary in size. For example, a chunk could be two feet wide. Other chunks could be larger or smaller.

The asphalt recycling system includes a chute that receives the used asphalt materials, which are placed into a load hopper. Inside the system, the asphalt materials are heated in a heating chamber, such as by natural gas, propane, or another heat source. The heating chamber warms the metal in the chute, and the asphalt material in the chute can be exposed to exhaust gas. Accordingly, the asphalt material is preheated by the exhaust gas and then is delivered through the chute and onto a conveyer belt, which drops down into a rotating drum. As the asphalt material travels, it is heated by conduction by coming in contact with the heated drum wall and by radiant and convective heat from the heated air moving through the drum. In the early stage of the drum, a material classifier ring retains the material until it has been reduced to a predetermined size whereupon it passes through the material classifier ring into the later stage of the drum.

The later stage of the drum includes a plurality of paddles that are used to tumble the heated asphalt material until it becomes generally granularized and mixes thoroughly with a rejuvenating additive. The drum can be manipulated (e.g., tilted, etc.) so that the material can be maintained in the drum until the asphalt material is ready to be reused. The direction and speed of the drum rotation can also be changed as necessary until the transformation of the asphalt material is complete.

When ready, the asphalt material exits the drum through a cam operated outlet door shutter. This door shutter operates by engaging a cam which pulls the outlet door to the next position (either open or closed) as the drum rotates. This mechanism operates with the drum rotation either forward or in reverse. The finished asphalt material falls through an outlet chute onto an outlet conveyer. On the bottom of the outlet chute is a spring-loaded door that closes after the asphalt material passes through to preserve heat in the chamber. The conveyer can move up or down and swivel from side to side to deliver the finished asphalt material to the operator designated spot.

Accordingly, the drum is used to generally granularize the asphalt material. The heat softens the asphalt material and evaporates any water. Materials can be mixed with the asphalt materials, such as oil and other materials to help make the asphalt material ready for reuse. Once ready, the asphalt materials are reused.

In one embodiment of the present invention, the system is a mobile unit. In this embodiment, patch work in remote locations can be performed.

In another embodiment of the present invention, the system is large and relatively immobile. In this embodiment, large amounts of asphalt can be recycled.

While the methods and processes of the present invention have proven to be particularly useful in the area of road construction, those skilled in the art can appreciate that the methods and processes can be used in a variety of different applications and in a variety of different areas of manufacture for the utilization of recycled asphalt material.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which:

FIG. 3 illustrates different views of a representative load hopper of the system;

DETAILED DESCRIPTION OF THE INVENTION

The present invention relates to recycling asphalt. In particular, the present invention relates to systems and methods for receiving used asphalt materials, including RAP and asphalt chunks, heating the materials, dynamically tumbling the materials into a recycled granulized form, and selectively providing the recycled asphalt for use.

Embodiments of the present invention embrace an asphalt recycling system that is configured to receive used asphalt materials, including RAP and asphalt chunks. When asphalt is broken or torn up from a road, for example, the asphalt recycling system is brought in and actuated. The asphalt material includes RAP, which includes the small granular output of asphalt milling machines, and chunks, which are not granularized. An asphalt chunk can vary in size. For example, a chunk could be two feet wide. Other chunks could be larger or smaller.

In one embodiment, the asphalt recycling system includes a chute that receives the used asphalt materials, which are placed into a load hopper. Inside the system, the asphalt materials are heated in a heating chamber, such as by natural gas, propane, or another heat source. The heating chamber warms the metal in the chute, and material in the chute can be exposed to exhaust gas. Accordingly, the asphalt material is preheated by the exhaust gas and then is delivered through the chute and onto a conveyer belt, which drops down into a rotating drum. The drum includes a plurality of paddles that are used to tumble the heated asphalt material until it becomes generally granularized. The drum can be manipulated (e.g., tilted, etc.) so that the material can be maintained in the drum until the asphalt material is ready to be reused. Accordingly, the drum is used to generally granularize the asphalt material. The heat softens the asphalt material and evaporates any water. Materials may be mixed with the asphalt materials, such as oil and other materials to help make the asphalt material ready for reuse. Once ready, the asphalt materials are reused.

Figure 1:
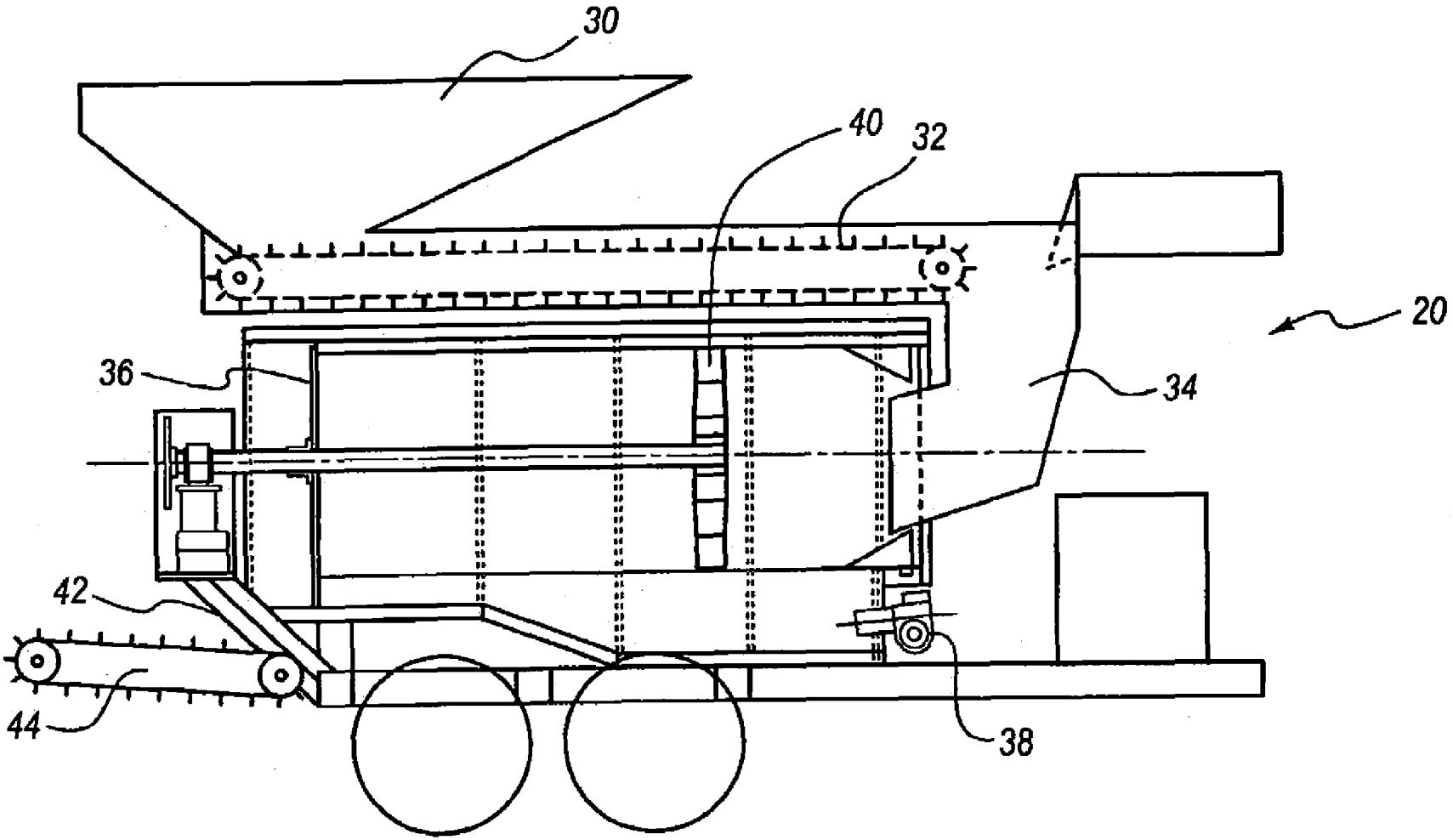
FIG. 1 illustrates a side view of a representative asphalt recycling system.
Figure 2A:
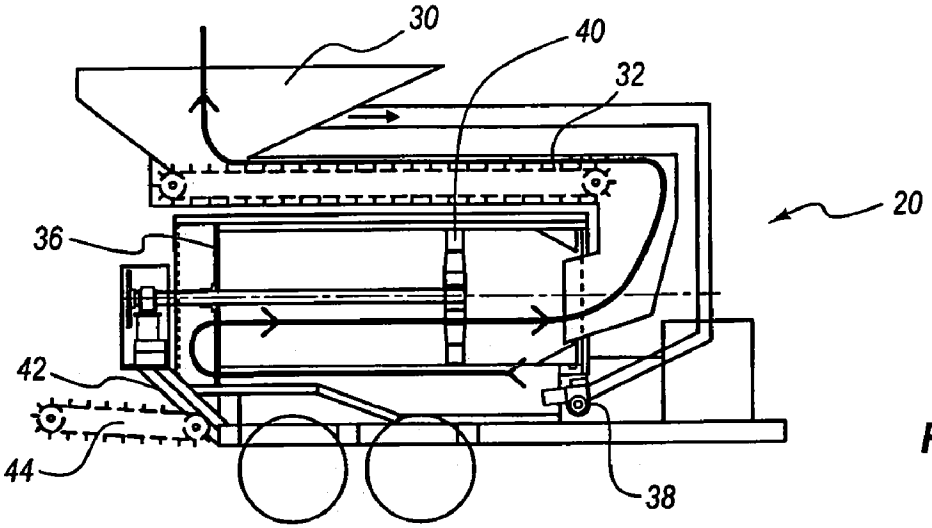
FIG. 2 illustrates a side view of a representative asphalt recycling system showing the heat flow and tilting function.
Figure 2B:
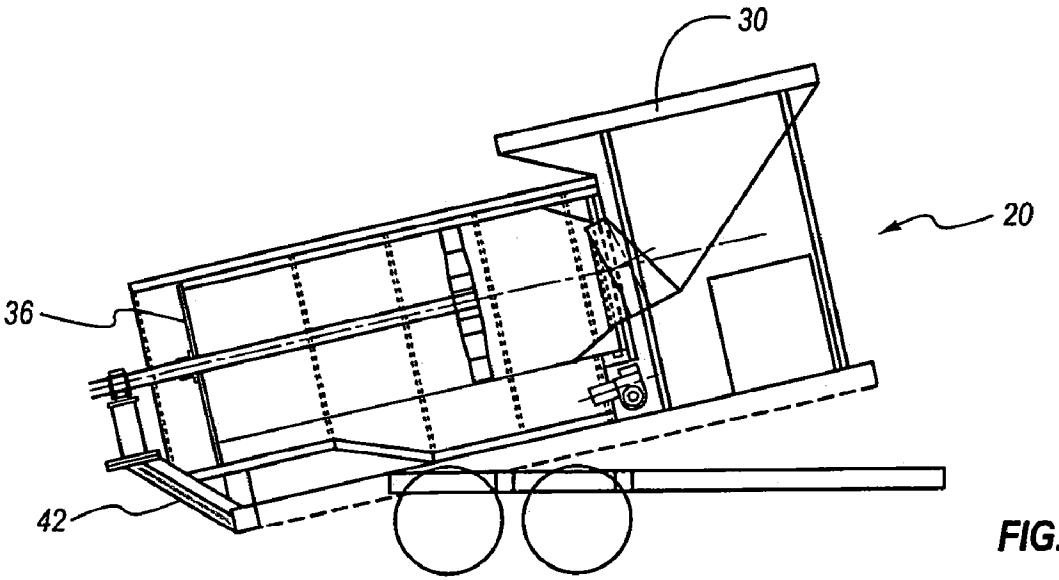
Figures 4A, 4B, 4C, 4D, 4E, 4F, 4G:
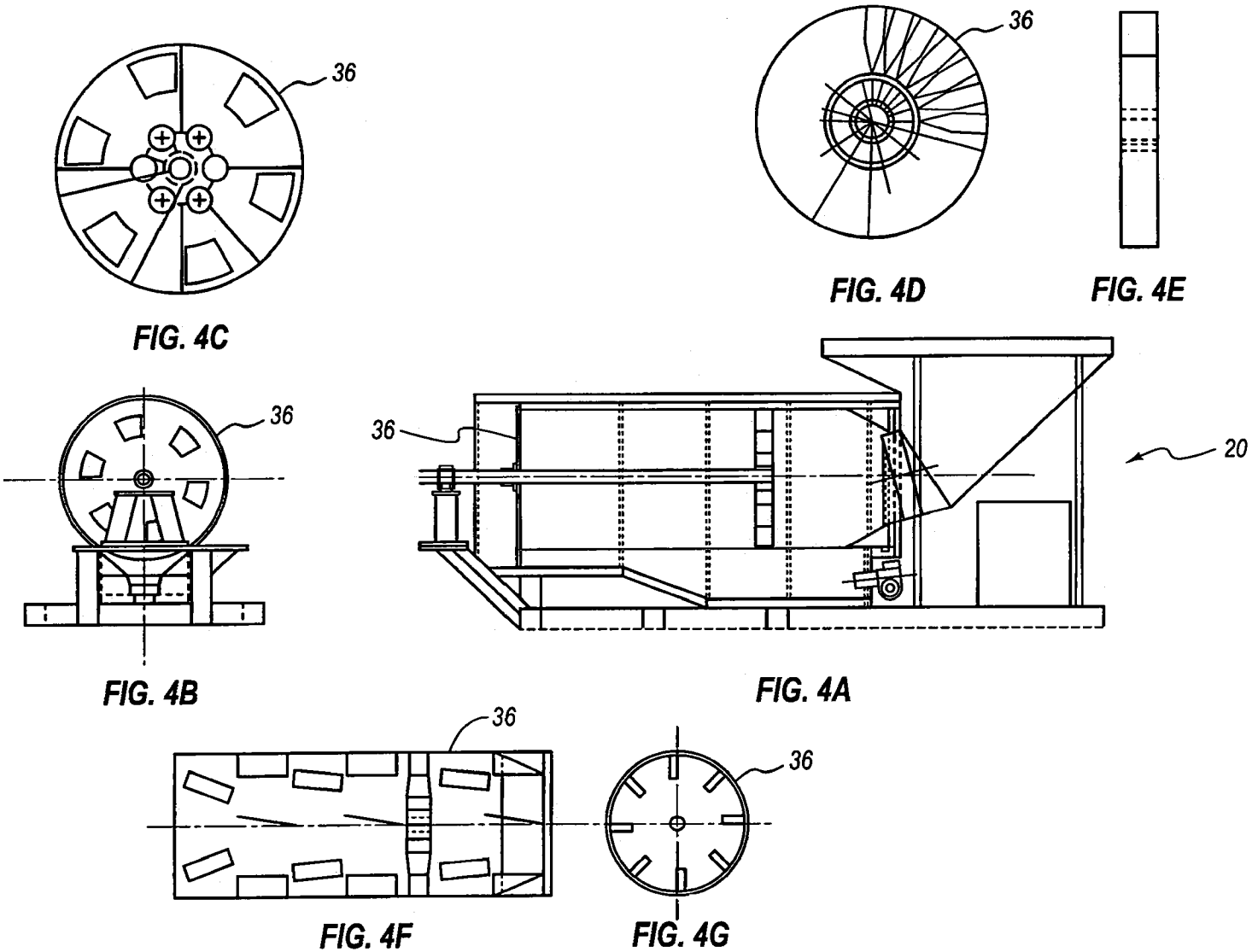
FIG. 4 illustrates an additional side view of a representative asphalt recycling system including a material classifier ring.
Figure 5C:
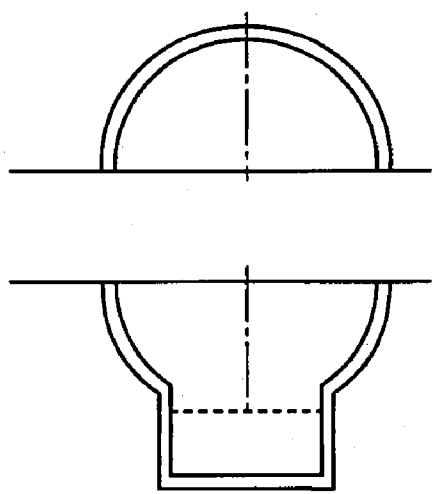
FIG. 5 illustrates another view of the system and various components of the system.
Figure 5A:
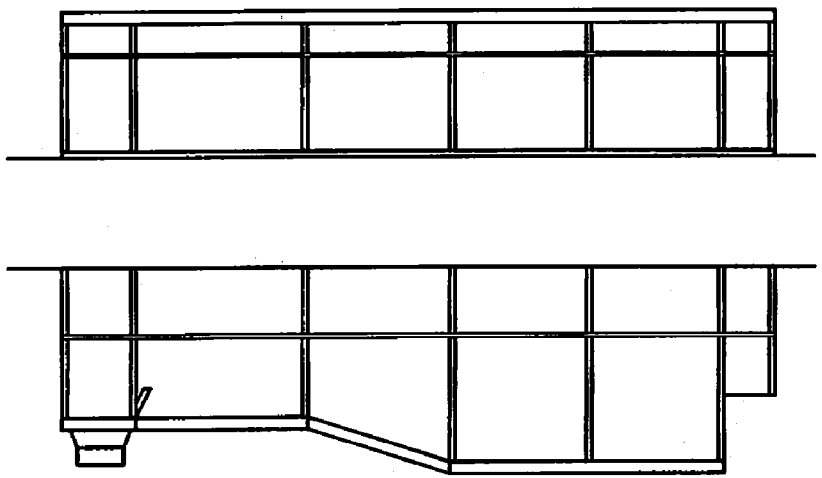
Figure 5D:
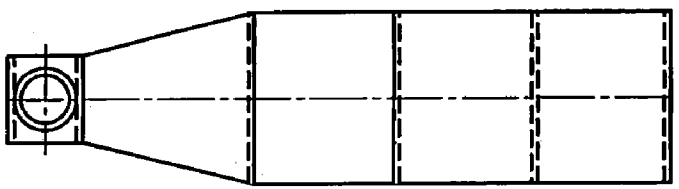
Figure 5B:
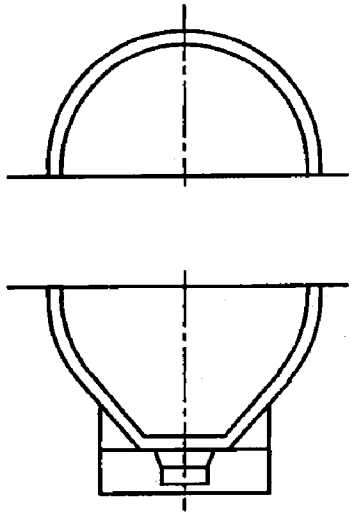
Figure 6A:
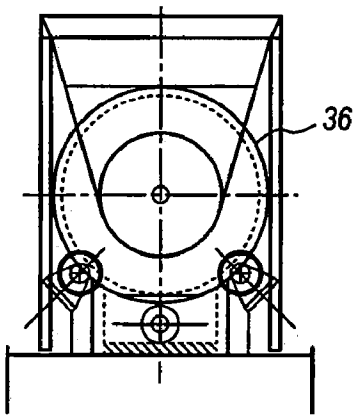
FIG. 6 illustrates an additional side view of a representative system and various components of the system.
Figure 6C:
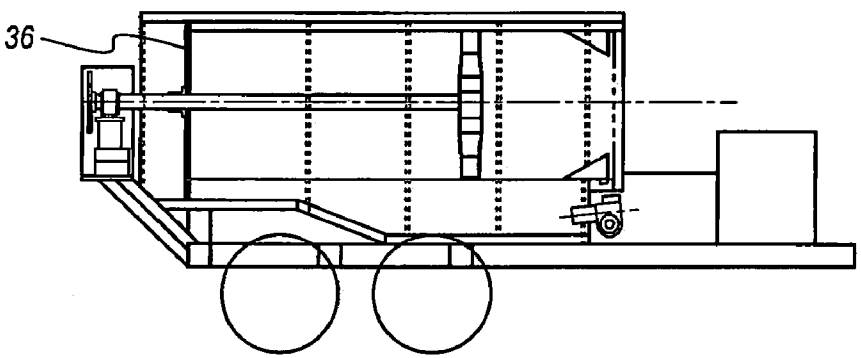
Figure 6B:
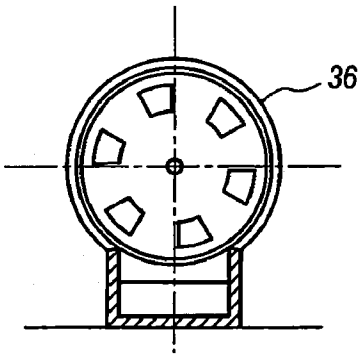
Figure 6D:
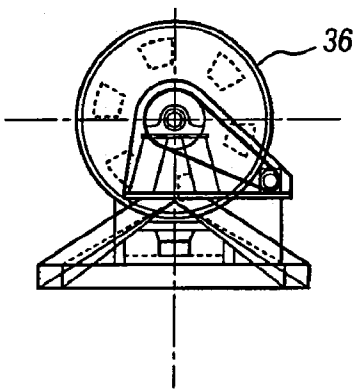
Figure 7E:
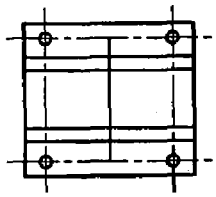
FIG. 7 illustrates additional details relating to a representative support roller and brackets.
Figure 7D:
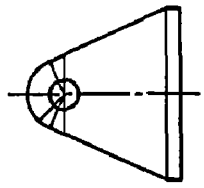
Figure 7C:
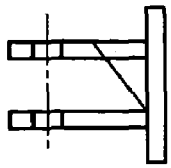
Figure 7H:
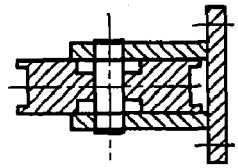
Figure 7G:
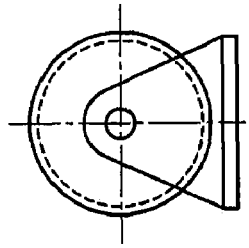
Figure 7B:
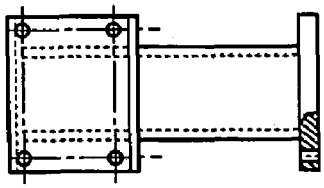
Figure 7A:
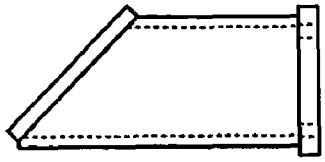
Figure 7F:
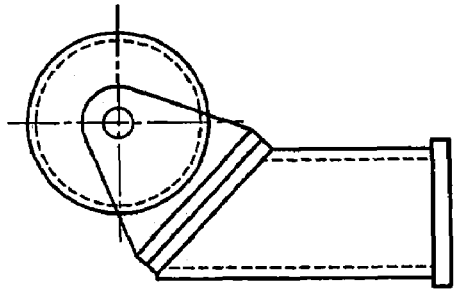

With reference now to FIGS. 1–7, representative asphalt recycling systems are represented with a variety of components. FIG. 1 illustrates a side view of a representative asphalt recycling system. FIG. 2 illustrates a side view of a representative asphalt recycling system showing the heat flow and tilting function. FIG. 3 illustrates different views of a representative load hopper of the system. FIG. 4 illustrates an additional side view of a representative asphalt recycling system including a material classifier ring. FIG. 5 illustrates another view of the system and various components of the system. FIG. 6 illustrates an additional side view of a representative system and various components of the system. FIG. 7 illustrates additional details relating to a representative support roller and brackets.

While some embodiments of the present invention embrace the utilization of an asphalt recycling system to recycle asphalt, other embodiments embrace using the system as a batch plant to produce new asphalt.

The system of FIG. 1 loosens up the used asphalt material. The rocks of the asphalt material are bound together by asphalt and when they are heated, they can separate. Accordingly, at least some embodiments of the present invention include a system that heats the asphalt and makes it soft so that the rocks may be let loose. Accordingly, in at least some embodiments, the rocks are still at least partially coated but are broken up by the systems and methods of the present invention.

In at least some embodiments, the heating chamber or drum can be tilted up or down to slow the progress of recycling the asphalt or reverse the progress of the asphalt material. For example, if the operator was going to pour the asphalt material out the end of the system, but the operator did not have a hotbox, a location for the asphalt material to go, or the asphalt material needed more mixing, the operator could reverse the system and cause the asphalt material to go back inside or stay close to the heating chamber to keep the asphalt material ready.

Alternatively, if the operator notices that the gravel is not drying fast enough, the operator can reverse the process and make it go through the drying process one more time before the asphalt material is removed from the system. Thus, reasons for changing the speed and direction of the system include to affect the dryness of the aggregate and/or the size of the asphalt material.

In at least some embodiments, there are doors on the ends of the system called shutters, as provided in the drawing set. A plate corresponds to the shutters and is indexed so to selectively allow asphalt material to pass through when aligned. Accordingly, when it is aligned, the material passes through or otherwise falls out of the bottom as it is rotating. When completed, the plate rotates so that it is then closed to prevent the material from being dispensed or other wise passing through. Further, in the system, the paddles catch the asphalt material and selectively move it to agitate the asphalt material.

FIG. 1 includes a pivoting conveyer belt that selectively pivots and raises/lowers. Thus, the pivoting conveyor can be used to selectively dispense the recycled asphalt material. If for some reason it is coming out too fast and falling off the belt, the conveyor can be tilted or otherwise adjusted to slow down or stop the process, for example.

In a further embodiment, the system includes one or more flaps that are hinged. So, for example, the weight of the asphalt material actuates the flap to allow the asphalt material to be dispensed through the flap.

In one embodiment, when new aggregate is being made, gravel is placed in the chute, dried out and pelletized tar pellets are added. Accordingly, the system may be used as a continuous batch plant.

A material classifier ring is included to stop the chunks from going all the way through. As provided above, the material classifier ring includes a number of paddles and there is a spacing between the flat part of those paddles. In one embodiment, the paddles are the same distance apart at one point and that is the size of asphalt material that is allowed to pass through.

In one embodiment, the paddles rotate with the drum. The asphalt material is moved by the paddles and when the material is small enough, it just falls through the spacing.

In one embodiment, the tilting of the chamber is performed independent from the trailer frame. In a further embodiment, the drum is on its own frame, and independent from the trailer frame is a hydraulic ram that tilts the angle. The heater is there and blows hot air along the bottom so as to heat the whole drum.

In another embodiment, as illustrated in FIG. 1, an asphalt recycling system includes a load hopper at the other end and has a conveyer belt that goes across the top and then drops it down inside. It allows the hot air to travel up into the load hopper.

Features of embodiments of the present invention include the ability to process used asphalt. In particular, embodiments of the present invention are able to recycle RAP and asphalt chunks. Further, embodiments embrace asphalt materials being heated by convection heating and by conduction heating by contact with a drum, not just radiation convection. This is because the air flows along the bottom of the drum and makes it hot. In addition, the system heats by convection and radiation when the material is not in contact.

Another feature of an embodiment of the present invention includes being able to use the system to patch roads in remote areas that are significant distances from traditional asphalt plants. Another feature is that the system may be used to heat road base. Sometimes in the winter, when workers are fixing potholes, the road base is wet when they dig it out because the asphalt is cracked, allowing rain water to get in. However, the workers cannot put asphalt on top of wet road base because the asphalt won't adhere to the road base. Accordingly, the system allows the road base to be passed through the system and dried.

In contrast, a different function of the present invention includes being able to use the system in a fixed or immobile condition. This embodiment is conducive to the processing of large amounts of asphalt.

Further features include allowing the system to be used when an asphalt plant is not open or available, or in undesirable weather, such as during the winter.

Taking a closer look now at FIG. 1, an Asphalt Recycling System 20 consists of a load hopper 30, a conveyer belt 32, a chute 34, a drum 36, a heat source 38, a material classifier ring 40, a shutter 42, and an outlet conveyer 44. In this embodiment, asphalt material (not shown in figure) enters load hopper 30 and travels along conveyer belt 32 until it reaches chute 34. Chute 34 delivers said asphalt material into drum 36 where said asphalt material is generally granularized by the material classifier ring 40 and by the tumbling action of drum 36. Once granularized, asphalt material exits Asphalt Recycling System 20 through shutter 42 and travels along outlet conveyer 44.

Thus, as discussed herein, embodiments of the present invention embrace recycling asphalt. In particular, the present invention relates to systems and methods for receiving used asphalt materials, including RAP and asphalt chunks, heating the materials, dynamically tumbling the materials into a recycled granulized form, and selectively providing the recycled asphalt for use. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An asphalt recycling system comprising:

a load hopper configured to receive asphalt material;

a conveyer belt connected to said load hopper and configured to transport said asphalt material;

a chute coupled to said conveyer belt;

a drum coupled to said chute wherein said drum tumbles and mixes said asphalt material;

a heat source that heats said asphalt recycling system;

a material classifier ring configured within said drum in order to granularize said asphalt material;

a shutter coupled to said drum; and an outlet conveyer configured to receive said asphalt material after it exits said drum.

2. An asphalt recycling system as recited in claim 1, wherein said heat source is housed within a heat chamber.

3. An asphalt recycling system as recited in claim 2, wherein said heat source heats said asphalt material using at least one of the following methods:

(i) conduction;

(ii) convection; and (iii) radiation.

4. An asphalt recycling system as recited in claim 1, wherein said heat source is provided so as to apply heat to an exterior of said drum to heat said asphalt material by conduction and wherein the recycling system is configured to direct exhaust and heated air from said heat source through the interior of said drum and then through said chute to heat said asphalt material by radiation and convection.

5. An asphalt recycling system as recited in claim 1, wherein said material classifier ring prevents said asphalt material from passing said material classifier ring in said drum until said asphalt material is smaller than a certain size.

6. An asphalt recycling system as recited in claim 5, wherein said material classifier ring comprises a number of paddles with spaces between said paddles, said spaces determining the size of said asphalt material that is allowed to pass said material classifier ring.

7. An asphalt recycling system as recited in claim 6, wherein said material classifier ring is located in an early stage of said rotating drum.

8. An asphalt recycling system as recited in claim 7, wherein said drum comprises a plurality of paddles located in a later stage of said drum that facilitates tumbling of said asphalt material.

9. An asphalt recycling system as recited in claim 1, wherein said material classifier ring comprises a number of paddles with spaces between said paddles, said spaces determining the size of said asphalt material that is allowed to pass said material classifier ring.

10. An asphalt recycling system as recited in claim 9, wherein said material classifier ring is located in an early stage of said rotating drum.

11. An asphalt recycling system as recited in claim 10, further comprising a plurality of paddles located in a later stage of said drum.

12. An asphalt recycling system comprising:

a load hopper configured to receive asphalt material;

a conveyer belt connected to said load hopper and configured to transport said asphalt material;

a chute coupled to said conveyer belt;

a drum coupled to said chute wherein said drum tumbles and mixes said asphalt material;

a heat source that heats said asphalt recycling system, wherein said heat source is provided so as to apply heat to an exterior of said drum to heat said asphalt material by conduction and wherein the recycling system is configured to direct exhaust and heated air from said heat source through the interior of said drum and then through said chute to heat said asphalt material by radiation and convection;

a material classifier ring configured within said drum in order to granularize said asphalt material;

a shutter coupled to said drum; and an outlet conveyer configured to receive said asphalt material after it exits said drum.

13. An asphalt recycling system as recited in claim 12, wherein said material classifier ring comprises a number of paddles with spaces between said paddles, said spaces determining the size of said asphalt material that is allowed to pass said material classifier ring.

14. An asphalt recycling system as recited in claim 12, wherein said drum comprises a plurality of paddles located in a later stage of said drum that facilitates tumbling of said asphalt material.

15. An asphalt recycling system comprising:

a load hopper configured to receive asphalt material;

a conveyer belt connected to said load hopper and configured to transport said asphalt material;

a chute coupled to said conveyer belt;

a drum coupled to said chute wherein said drum tumbles and mixes said asphalt material;

a heat source that heats said asphalt recycling system;

a material classifier ring configured within said drum in order to granularize said asphalt material, wherein said material classifier ring prevents said asphalt material from passing said material classifier ring in said drum until said asphalt material is smaller than a certain size and wherein said material classifier ring comprises a number of paddles with spaces between said paddles, said spaces determining the size of said asphalt material that is allowed to pass said material classifier ring;

a shutter coupled to said drum; and an outlet conveyer configured to receive said asphalt material after it exits said drum.

16. An asphalt recycling system as recited in claim 15, wherein said heat source heats said asphalt material using at least one of the following methods:

(i) conduction;

(ii) convection; and (iii) radiation.

17. An asphalt recycling system as recited in claim 15, wherein said heat source is provided so as to apply heat to an exterior of said drum to heat said asphalt material by conduction and wherein the recycling system is configured to direct exhaust and heated air from said heat source through the interior of said drum and then through said chute to heat said asphalt material by radiation and convection.

18. An asphalt recycling system as recited in claim 15, further comprising a pivoting conveyor belt proximate said shutter and selectively dispensing said asphalt material.

19. An asphalt recycling system as recited in claim 15 wherein the system is a mobile unit.

20. An asphalt recycling system as recited in claim 15 wherein the system is large and immobile.

* * * * *